US010617968B2

(12) United States Patent
Davis

(10) Patent No.: US 10,617,968 B2
(45) Date of Patent: Apr. 14, 2020

(54) BUILDING BLOCKS

(71) Applicant: Joshua Davis, Brentwood, TN (US)

(72) Inventor: Joshua Davis, Brentwood, TN (US)

(73) Assignee: Joshua Davis, Brentwood, TN (US)

( * ) Notice: Subject to any disclaimer, the term of this patent is extended or adjusted under 35 U.S.C. 154(b) by 0 days.

(21) Appl. No.: 16/072,775

(22) PCT Filed: Aug. 24, 2016

(86) PCT No.: PCT/US2016/048301
§ 371 (c)(1),
(2) Date: Jul. 25, 2018

(87) PCT Pub. No.: WO2018/038714
PCT Pub. Date: Mar. 1, 2018

(65) Prior Publication Data

US 2019/0054389 A1 Feb. 21, 2019

(51) Int. Cl.
*A63H 33/10* (2006.01)
*A63H 33/08* (2006.01)

(52) U.S. Cl.
CPC ..... *A63H 33/086* (2013.01); *A63H 33/088* (2013.01); *A63H 33/105* (2013.01); *A63H 33/108* (2013.01)

(58) Field of Classification Search
CPC ..... A63H 33/086–088; A64H 33/04–108
USPC ..... 446/124, 128
See application file for complete search history.

(56) References Cited

U.S. PATENT DOCUMENTS 3,005,282 A * 10/1961 Christiansen ..... A63H 33/086 446/128
4,003,144 A * 1/1977 Maddestra ..... A63F 9/0098 434/403
5,306,198 A * 4/1994 Forman ..... A63F 9/0098 446/116
5,554,062 A * 9/1996 Goldsen ..... A63F 9/0098 434/171

(Continued)

FOREIGN PATENT DOCUMENTS

WO WO-2008078942 A1 * 7/2008 ..... A63H 33/067
WO WO-2012005567 A1 * 1/2012 ..... A63H 9/00

OTHER PUBLICATIONS

Brick Generate, "plate, 2x2, studs on both sides", https://brickgenerate.wordpress.com/2013/08/07/plate-2x2-studs-on-both-sides, posted Aug. 7, 2013 (Year: 2013).*

*Primary Examiner* — Laura Davison

(57) ABSTRACT

A building block of six female sides wherein each side of the block is adapted to accept a male side of a second different block. The first block is made up of a cross form comprised of tubular projections, a skeleton block form, and connection components connecting the cross form to the skeleton block form. The second different blocks are made up of at least four generally cylindrical projections extending normally outward from the base plate of the block that may be inserted into any of the six sides of the first block and interconnect by frictional engagement. These blocks can be interconnected and assembled into a block structure that has both a finished outward appearance in which each outermost side of every block is customizable and provides internal passageways for adding structural elements, wiring, lighting or anything else needed to run through the blocks and block structure.

5 Claims, 4 Drawing Sheets

(56) References Cited

U.S. PATENT DOCUMENTS

| | | | | |
|---|---|---|---|---|
| 5,924,906 | A * | 7/1999 | Grafton | A63H 33/10 411/339 |
| 6,641,453 | B1 * | 11/2003 | Morales | A63H 33/04 273/157 R |
| 6,645,044 | B2 * | 11/2003 | Zuniga | B24B 37/30 451/28 |
| 6,691,485 | B1 * | 2/2004 | Prokofyev | E04B 2/14 52/405.1 |
| 7,347,028 | B1 * | 3/2008 | Bin-Nun | A63H 33/086 446/112 |
| 7,507,136 | B2 * | 3/2009 | Patton | A63H 33/046 335/285 |
| D614,248 | S * | 4/2010 | Pedersen | D21/499 |
| 8,408,549 | B2 * | 4/2013 | Howard | A63F 9/0413 273/146 |
| 8,469,764 | B2 * | 6/2013 | Weber | A63H 33/088 446/121 |
| 8,495,850 | B1 * | 7/2013 | Lin | E04B 2/18 52/592.6 |
| 8,753,164 | B2 * | 6/2014 | Hansen | A63H 33/042 446/85 |
| 8,801,491 | B2 * | 8/2014 | Bruder | A63H 33/101 446/124 |
| 2008/0236510 | A1 * | 10/2008 | Silverman | A01K 1/034 119/479 |
| 2013/0115849 | A1 * | 5/2013 | Yap | A63H 9/00 446/128 |
| 2015/0298019 | A1 * | 10/2015 | Sokolov | A63H 33/08 446/124 |

* cited by examiner

BUILDING BLOCKS

TECHNICAL FIELD

This invention relates to building blocks, and in particular, to building blocks that can be interconnected in many different manners to create various structures.

BACKGROUND ART

Building blocks as construction toys help in developing hand eye coordination with children. In addition, building blocks provide children and adults with entertainment and help to push their creativity in building structures out of these blocks.

One type of building block which is popular with children and adults is the hollow plastic toy building blocks. These blocks typically have a top side that is the male side with the projections that extend from surface of the block, while the bottom side is the female side that is the receiving side, the other four sides of these blocks are the walls. As such, these blocks are connected to each other in a stacking fashion where the projections of the top side of a lower positioned building block are frictionally engaged to the bottom surface or the female side of another similar block. Such blocks are shown and described in expired U.S. Pat. Nos. 3,005,282 and 6,645,033.

These blocks are thus limited in that they must be interconnected in a single orientation. With blocks of this type, it is not possible to interconnect a block to any of the sides of these blocks, as they are only able to be joined together at these opposing side faces and stacked in one direction. Thus, to build a structure that spans a distance and that is elevated from the floor plane, these blocks must be connected to each other and linked together, usually in a corbel arch stacking technique. As such, these type of blocks are limited as to what type of building structures they can make.

Building blocks having multiple sides, specifically six sides, for interconnecting to one another similar building blocks is also available. One building block of this type is US Pat. No. 20130115849A1 or WO2012005567. This block has six identical faces in which each face has both male and female parts. As such, each face of this block may be interconnected to a similar face of another similar building block.

A drawback of this type of block is that each block is connected to another similar block. So, the blocks when connected are directly adjacent to each other and face to face. This causes issues when the block structure is made and if finish blocks were designed to be installed onto these, as many different finish blocks would have to be created to be able to achieve a smooth outward appearance to the block structure.

A limitation of both of these types of blocks is that once these blocks are interconnected together to assemble a larger structure, then there is no passageway within the blocks to add wiring, cable, rope, lighting or structural elements. So, even if the building blocks are capable of being connected side by side, they are limited as to the distance these blocks could span based on the characteristics of the blocks themselves.

Another drawback of both of these types of blocks is the appearance. After these blocks are assembled into a larger structure, these blocks have the outer appearance of children's toys in that the male and female parts being used for the connection of these blocks is visible.

Another drawback of both of these types of blocks is that each side of the block is not customizable. The sides of these blocks must be the color of the block itself. Thus, one side of a block can't be a different color than the adjacent side of the same block.

SUMMARY OF INVENTION

It is an objective of the present invention to present a set of building blocks that are capable of being assembled into a larger structure that has a finished outward appearance.

It is a further objective of the present invention to present a set of building blocks that, once assembled, are internally functional in that the blocks themselves provide passageways for adding structural elements, wiring, lighting or anything else needed to run through the blocks and block structure.

Another objective of the present invention is to make a set of building blocks that can be customizable, as in each side of a building block can be finished with a different color or design. A set of building blocks includes a block of six female sides (hereinafter called the "base block") (sides may also be referred to as faces, i.e, when the word side or sides is used this word can/may be interchanged with the word face or faces and is intended to have the same meaning), a block that connects one base block to another base block (hereinafter called the "connector block"), and a block that connects to any of the open sides of the base block to finish the outward appearance of the block structure (hereinafter called the "finish block"). A plurality of these blocks may be interconnected together to assemble toy structures, furniture, interior walls, architectural models, signage and many other structures that are built for functional, entertainment or educational purposes. An assembled structure made up of the interconnected blocks has a finished outward appearance and has passageways within the block structure created within the blocks themselves.

The base block has six female sides wherein each side is adapted to accept a male side of a second different block. The base block is made up of a cross form comprised of tubular projections, a skeleton block form, and connection components connecting the cross form to the skeleton block form. A second different block with at least four generally cylindrical projections extending normally outward from the base plate of the second block may be inserted into any of the six sides of the base block and interconnect by frictional engagement. The relationship of this frictional engagement is between the generally cylindrical projections of the second block being inserted into the base block wherein each generally cylindrical projection of the second block is engaged with at least one tubular projection of the cross form of the base block and at least one side of the skeleton block form of the base block. The second different block that connects to the base block may be the connector block, the finish block, or a block with similar projections to these. Such blocks may be releasable and connectable with each other.

In the preferred embodiment of the base block, the building block is substantially cubical in shape and has six female sides wherein one generally tubular projection at each of the six sides extends normally from the general center of the base block. These six generally tubular projections of the preferred embodiment base block form together into one single integral cross form as they come together in the general center of the block. At the edges of each face of the base block are edge angles which are positioned so the outside point of each angle is pointing towards the inside of the block. These angles at the edges of each face of the base block form a general square shape. These general square shapes made up of the angles are formed together with each other as to make a single integral skeleton block form. The cross form and the skeleton block form are connected together with the connection components. In this preferred embodiment the connection components are positioned in the general middle of each side of the block, wherein when viewed from each side there are four connection components that are connecting the cross form to the skeleton block form. The cross form, the skeleton block form, and the connection components are formed together as an integral unit and formed complete by a single injection molding process. Each of the six sides of the preferred embodiment base block is positioned and shaped to accept the insertion of four generally cylindrical projections extending outward from the base plate of a second different block, so that each projection of the second block is frictionally engaged with the general tubular projection of the cross form and the edge angles of the skeleton block form of the base block. The holes of the generally tubular projections of the base block extend through the base block to provide passageways from any side of the base block to the opposite side of the base block.

In the preferred embodiment of the connector block, the building block is a generally square base plate with four generally cylindrical projections extending outward from both sides of the base plate and arranged in two rows of opposed projections to define a square on each side, from which a hole on the base plate is generally located in the general center of the square made by the rows of projections. The four edges of the base plate of this block are double beveled. The edges are double beveled to facilitate one face of the double beveled edge mating with either another face of a double beveled edge of a connector block or a beveled edge of a finish block. The thickness of the connector block from the locations that it engages the base block when connecting two base blocks is generally twice the thickness of the finish block from the location that the finish block engages the base block and the outer face of the finish block.

In the preferred embodiment of the finish block, the building block is a square base plate with four generally cylindrical projections extending outward from one side of the base plate and arranged in two rows of opposed projections to define a square. The four edges of the base plate of this block are beveled edges. The edges are beveled to facilitate the face of the beveled edge mating with either another face of a beveled edge of a finish block or one of the faces of a double beveled edge of a connector block. The thickness of the finish block from the location that it engages the base block to the outer face of the finish block is generally half the thickness of the connector block from the locations that the connector block engages the base block when connecting two base blocks.

These building blocks can be assembled together in a number of orientations to create many different structures. The connector blocks connect one base block to another base block. The four projections on one side of a connector block are inserted into one of the six sides of a base block. As the connector block is inserted into the base block the hole of the connector block is generally aligned with the hole of the tubular projection of the base block providing a passageway between the two blocks. Then, another base block can be attached to the other side of this connector block by inserting the projections of this side of the connector block into a second base block. Again, the hole of the connector block is generally aligned with the hole of the tubular projection of this second base block. This type of building with the base blocks and connector blocks can be done to assemble many structures. After these blocks are assembled passageways exist within these blocks to add structural elements, wiring, lighting or anything else needed to run through these blocks and block structure. After the assembly is complete with the base blocks and the connector blocks, the finish blocks can be added to finalize the structure and make the outward appearance of it finished.

An advantage of these building blocks over the stackable type building blocks with solid side walls is that these building blocks can be interconnected from any of the six sides, thus the block structures that can be created with these building blocks are capable of being more complex.

An advantage of these building blocks over the other type of building blocks with six sides for interconnecting to one another similar blocks, is the passageways in these building blocks allows for many more options that the prior art building blocks do not have such as adding structure and wiring through these passageways of the block structure.

An advantage of these building blocks over the prior art building blocks is that with a limited number of block types, three block types in particular, a complex block structure can be made that has a finished outward appearance and internal passageways.

Another advantage of these building blocks is that each of these building blocks are suitably adaptable for injection molding and each block made complete by a single injection molding process. These building blocks are preferably made from a resilient plastic material.

Another advantage is that the passageways that are created in these building blocks are made so that the passageways are centered in the blocks, the passageways are able to extend through all axes of the base block, and the passageways extend through the base blocks and through the connector blocks to create a continuous passageway for adding additional elements to the block structure.

With the passageways in these building blocks, this will create many more options for the building blocks. These blocks will be able to span greater distances than what was possible before, because structure such as metal round tubes, metal rods, wood dowels or some other similar structural element may be installed within the passageways of the blocks. These passageways can also be used for various types of wiring. This opens up the possibilities of creating some blocks that could be used as wall plates and have connectors installed in them to connect such devices as phone/data, audio/video, coaxial, usb, or any other connection type that may be useful to have in the block. With wiring being able to be installed in the passageways, this also opens up the possibility of the blocks being designed to be used as speakers. These passageways can also be used to install lighting elements within the passageways or wiring up a specialized block to be lit up. Lighting effects can be done easily with the use of these passageways in installing lighting elements such as lighting rope, lighting tubes, or something similar.

Another advantage to these building blocks is that the finish blocks can be attached to every side of every base block in the block structure, so each side of every block can be a different color or design based on the finish blocks.

MODES FOR CARRYING OUT THE INVENTION

Figure 1:
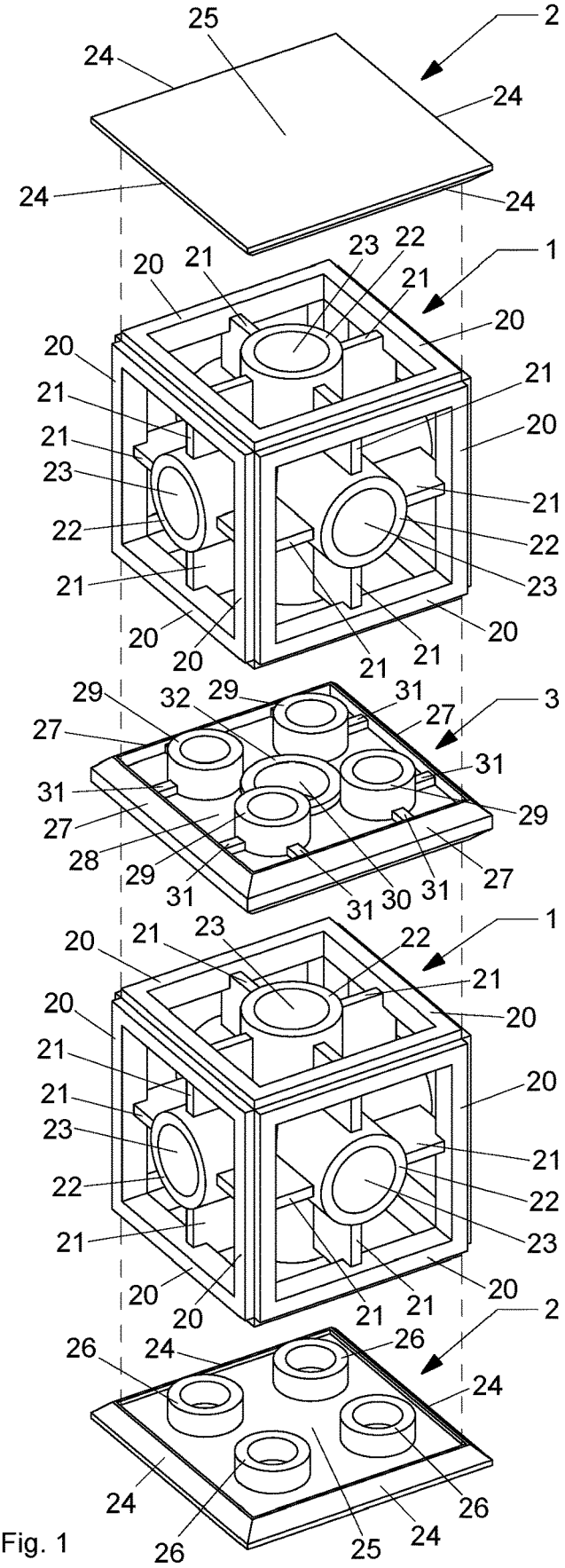
FIG. 1 is an exploded isometric view of building blocks according to the first embodiment of the present invention, from top to bottom: finish block, base block, connector block, base block, and finish block.
Figure 2:
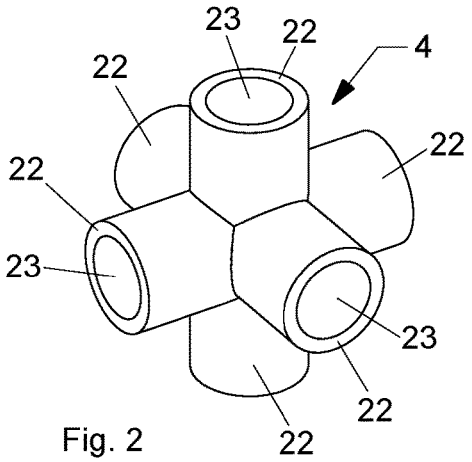
FIG. 2 is a isometric view of a cross form.
Figure 3:
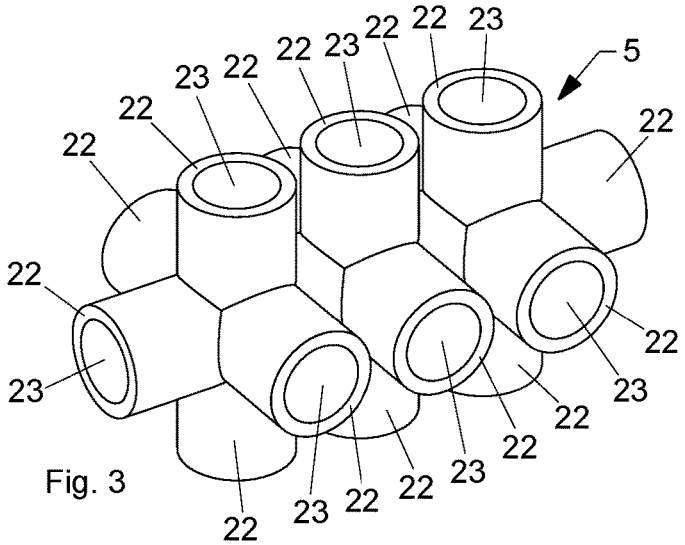
FIG. 3 is a isometric view of an extended cross form.
Figure 4:
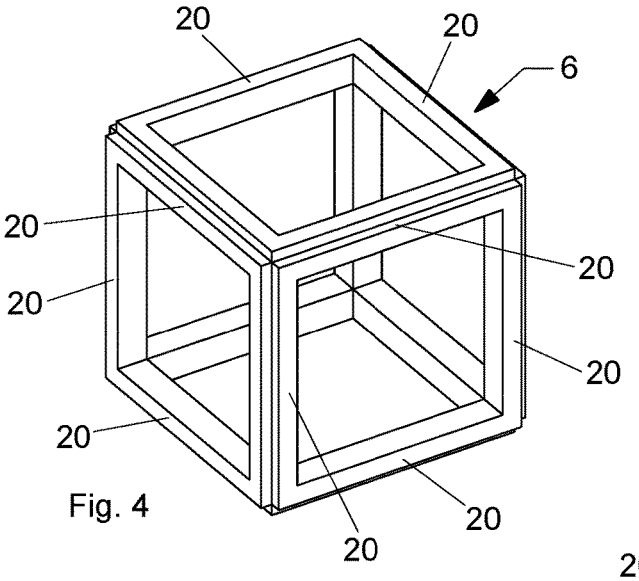
FIG. 4 is a isometric view of a skeleton block form.
Figure 5:
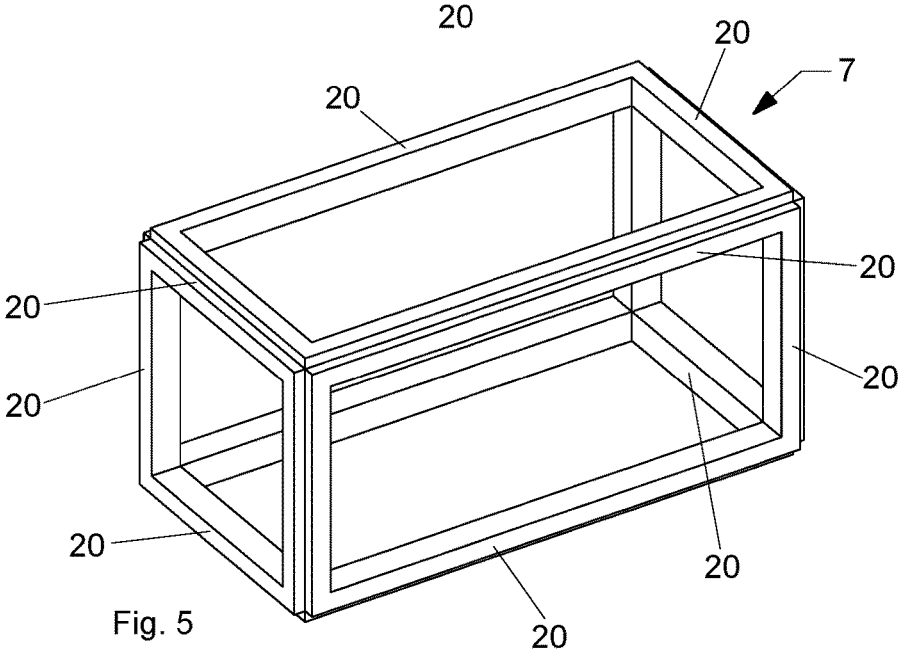
FIG. 5 is a isometric view of an extended skeleton block form.
Figure 6:
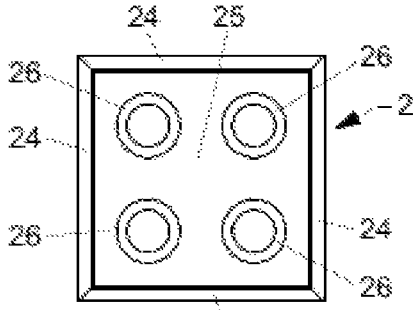
FIG. 6 is a bottom view of a first embodiment of a finish block.
Figure 7:
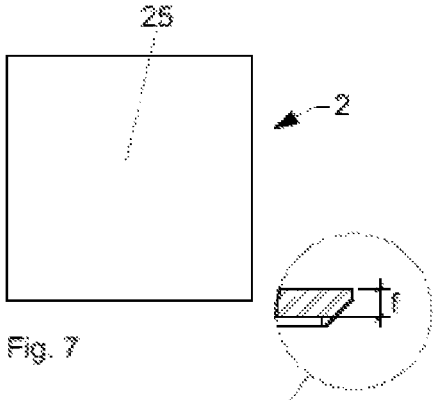
FIG. 7 is a top view of a first embodiment of a finish block.
Figure 8:
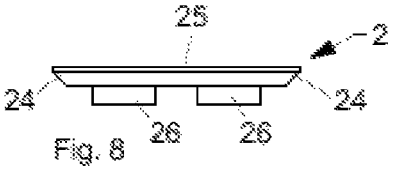
FIG. 8 is a elevation of a first embodiment of a finish block.
Figure 9:
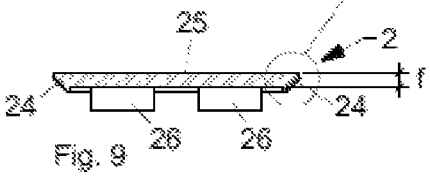
FIG. 9 is a section of a first embodiment of a finish block.
Figure 10:
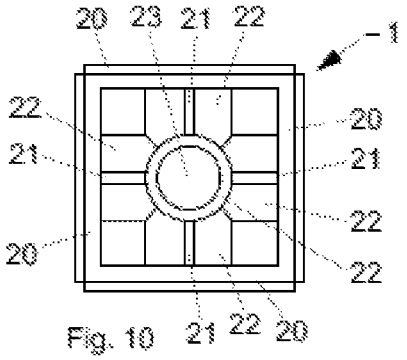
FIG. 10 is a top, bottom or side view of a first embodiment of a base block.
Figure 11:
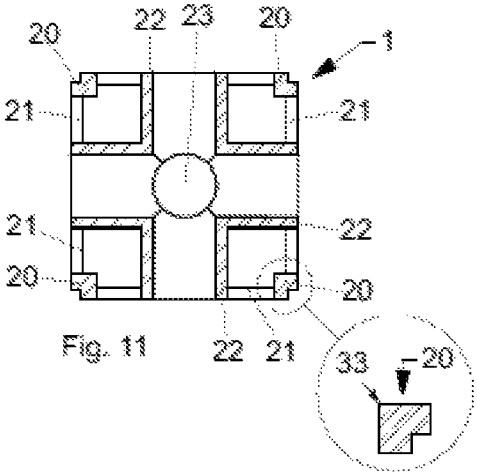
FIG. 11 is a section of a first embodiment of a base block.
Figure 12:
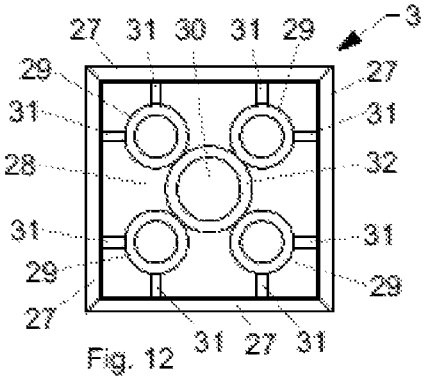
FIG. 12 is a top or bottom view of a first embodiment of a connector block.
Figure 13:
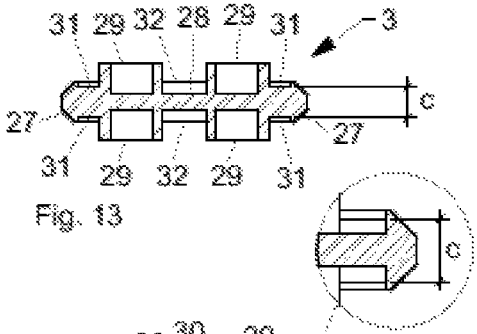
FIG. 13 is a section of a first embodiment of a connector block.
Figure 14:
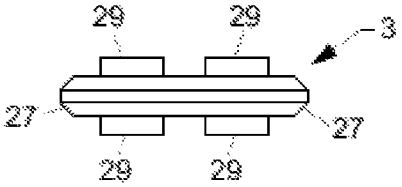
FIG. 14 is a elevation of a first embodiment of a connector block.
Figure 15:
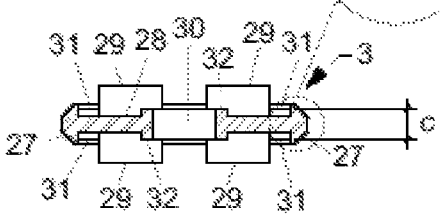
FIG. 15 is a section of a first embodiment of a connector block.
Figure 16:
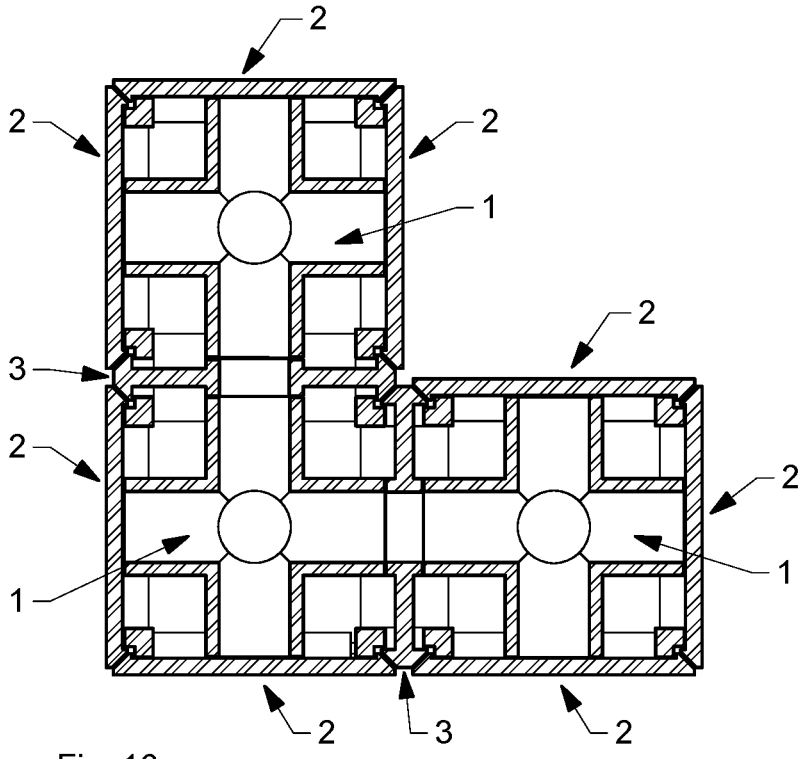
FIG. 16 is a section cut through the first embodiments of three base blocks, two connector blocks, and eight finish blocks showing the relationships of the three types of blocks when connected together.

A set of building blocks (FIG. 1) includes a base block (1) of six female sides, a connector block (3) that connects one base block to another base block, and a finish block (2) that connects to any of the open sides of the base block to finish the outward appearance of the block structure. A plurality of these blocks may be interconnected together to assemble toy structures, furniture, interior walls, architectural models, signage and many other structures that are built for functional, entertainment or educational purposes. An assembled structure made up of the interconnected blocks has a finished outward appearance and has passageways within the block structure created within the blocks themselves.

The base block (1) has six female sides wherein each side is adapted to accept a male side of a second different block. The base block is made up of a cross form (4 or 5) comprised of tubular projections (22), a skeleton block form (6 or 7), and connection components (21) connecting the cross form (4 or 5) to the skeleton block form (6 or 7). A second different block with at least four generally cylindrical projections extending normally outward from the base plate of the second block may be inserted into any of the six sides of the base block (1) and interconnect by frictional engagement. The relationship of this frictional engagement is between the generally cylindrical projections of the second block being inserted into the base block (1) wherein each generally cylindrical projection of the second block is engaged with at least one tubular projection (22) of the cross form (4 or 5) of the base block (1) and at least one side of the skeleton block form (6 or 7) of the base block (1). The second different block that connects to the base block may be the connector block (3), the finish block (2), or a block with similar projections to these. Such blocks may be releasable and connectable with each other.

In the preferred embodiment of the base block (1), the building block is substantially cubical in shape and has six female sides wherein one generally tubular projection (22) at each of the six sides extends normally from the general center of the base block (1). These six generally tubular projections (22) of the preferred embodiment base block (1) form together into one single integral cross form (4) as they come together in the general center of the block. At the edges of each face of the base block (1) are edge angles (20) which are positioned so the outside point (33) of each angle is pointing towards the inside of the block. These angles at the edges of each face of the base block form a general square shape. These general square shapes made up of the edge angles (20) are formed together with each other as to make a single integral skeleton block form (6). The cross form (4) and the skeleton block form (6) are connected together with the connection components (21). In this preferred embodiment the connection components (21) are positioned in the general middle of each side of the base block (1), wherein when viewed from each side there are four connection components (21) that are connecting the cross form (4) to the skeleton block form (6). The cross form (4), the skeleton block form (6), and the connection components (21) are formed together as an integral unit and formed complete by a single injection molding process. Each of the six sides of the preferred embodiment base block (1) is positioned and shaped to accept the insertion of four generally cylindrical projections (26 or 29) extending outward from the base plate (25 or 28) of a second different block (2 or 3), so that each generally cylindrical projection (26 or 29) of the second block (2 or 3) is frictionally engaged with the general tubular projection (22) of the cross form (4) and the edge angles (20) of the skeleton block form (6) of the base block (1). The holes (23) of the generally tubular projections (22) of the base block (1) extend through the base block (1) to provide passageways from any side of the base block (1) to the opposite side of the base block (1).

In the preferred embodiment of the connector block (3), the building block is a square base plate (28) with four generally cylindrical projections (29) extending outward from both sides of the base plate (28) and arranged in two rows of opposed projections to define a square on each side, from which a hole (30) on the base plate (28) is generally located in the center of the square made by the rows of projections. The four edges of the base plate (28) of this block are double beveled edges (27). The edges are double beveled to facilitate one face of the double beveled edge (27) mating with either another face of a double beveled edge (27) of a connector block (3) or a beveled edge (24) of a finish block (2). The four projections (29) on one side of a connector block (3) are inserted into on of the six sides of a base block (1). The connector block (3) could be made thicker throughout the base plate, however, for better plastic injection molding practices, the plate is cored out to achieve the desired thickness, thus the base plate extensions (31) and the circular base plate extension (32) are formed to create this thickness to engage with the base block (1) when connected.

The double beveled edges (27) of a connector block (3) can be double beveled at generally forty five degrees as to form a sharp point. However, the double beveled edges (27) may also flatten out at the outer most edge so as not to create a sharp point.

In the preferred embodiment of the finish block (2), the building block is a square base plate (25) with four generally cylindrical projections (26) extending outward from one side of the base plate (25) and arranged in two rows of opposed projections to define a square. The four edges of the base plate of this block are beveled edges (24). The edges are beveled to facilitate the face of the beveled edge (24) mating with either another face of a beveled edge (24) of a finish block (2) or one of the faces of a double beveled edge (27) of a connector block (3). The thickness of the finish block (2) from the location that it engages the base block (1) to the outer face of the finish block (2) is generally half the thickness of the connector block (3) from the locations that the connector block (3) engages the base block (1) when connecting two base blocks (1).

The beveled edges (24) of a finish block (2) can be beveled at generally forty five degrees as to form a sharp point. However, the beveled edges (24) may also flatten out at the outer most edge so as not to create a sharp point. A variation of this may also be desirable where a small indention is made at these edges to facilitate an easier removal of the finish blocks (2) from the base blocks (1).

The finish block (2) can be made with many different colors, finishes, and may have connections added for attaching a phone/data, audio/video, coaxial, or universal serial bus outlet. The finish block (2) can be attached to every outermost side of every base block (1) once the block structure is assembled, so each side of every block can be a different color or design based on the finish blocks (2). The outward finish of the finish block (2) can be smooth, rough, or have a pattern on it. These finish blocks (2) give the user many opportunities for customizing the block structure.

These building blocks can be assembled together in a number of orientations to create many different structures. The connector blocks (3) connect one base block (1) to another base block (1). The four projections (29) on one side of a connector block (3) are inserted into one of the six sides of a base block (1). As the connector block (3) is inserted into the base block (1) the hole (30) of the connector block (3) is generally aligned with the hole (23) of the tubular projection (22) of the base block (1) providing a passageway between the two blocks. Then, another base block (1) can be attached to the other side of this connector block (3) by inserting the projections (29) of this side of the connector block (3) into a second base block (1). Again, the hole (30) of the connector block (3) is generally aligned with the hole (23) of the tubular projection (22) of this second base block (1). This type of building with the base blocks (1) and connector blocks (3) can be done to assemble many structures. After these blocks are assembled passageways exist within these blocks to add structural elements, wiring, lighting or anything else needed to run through these blocks and block structure. After the assembly is complete with the base blocks (1) and the connector blocks (3), the finish blocks (2) can be added to finalize the structure and make the outward appearance of it finished.

These building blocks are preferably made from resilient plastic material that is suitably adaptable for injection molding and each block made complete by a single injection molding process.

These building blocks can be made in various sizes, while still maintaining the general shape and invention described. Each size may have some advantages to it. The smaller sizes may be more suitable for toy structures and may be adaptable with other toy blocks already on the market. The larger sizes may be more suitable for making larger structures. All sizes will have the capabilities of creating passageways through the blocks, but the larger the block size gets the larger the passageways will be capable of getting within the blocks that may allow more capabilities.

While the preferred embodiment of the present invention is for the base block (1) to be a general cube shape and the connector block (3) and the finish block (2) to have general square plates, these building blocks may have different shapes than described while still maintaining the invention described. The base block (1) of the preferred embodiment is comprised of a cross form (4) that is a six-way cross form, meaning it has six generally tubular projections (22) that make up the cross form. This cross form may be extended to be a ten-way cross form, a fourteen-way cross form (5), a eighteen-way cross form, and so on. Every time it is extended, four more tubular projections are added to the cross form to make the extension. The connector block and the finish block would be extended to correspond to the cross form, so as to make the base plates of these blocks generally rectangular in shape and the generally cylindrical projections of these blocks to be shaped and positioned to correspond with the insertion of the extended cross form.

While embodiments of the present inventions have been explained with reference to the examples above, the embodiments are non-limiting examples for illustrating the present inventions and should not be construed as to limit the scope of the invention. While the above building blocks have been explained with reference to being molded from plastic, it will be appreciated that these building blocks can be molded from other materials such as concrete, metal, or some other moldable material; or can be made from wood or metal components without the loss of generality.

I claim:

1. A building block system comprising:

a base block of six female faces, comprising:

an integral cross form comprising at least one generally tubular projection at each of the six female faces that extends normally from a general center of the base block wherein these tubular projections form together to create the integral cross form and wherein holes of the generally tubular projections of the integral cross form of the base block extend through the base block to provide passageways from each face of the base block to the opposite face of the base block; and an integral skeleton block form forming edges of each face of the base block wherein the edges of each face of the base block are formed together with the edges of each adjacent face of the base block to create the integral skeleton block form; and a plurality of connection components that connect the integral cross form to the integral skeleton block form; and a connector block for co-operation with the base block, comprising:

a base plate of the connector block that is generally flat and generally parallelogram shape having a first and second face on opposite sides of the base plate of the connector block; and at least four generally cylindrical projections extending normally outward from each of the first and second faces of the base plate of the connector block and arranged in two rows of opposed projections to define a square, wherein the first face of the connector block includes a first engagement surface configured to engage the edges of the base block when the first face of the connector block is attached to the base block, and the second face of the connector block includes a second engagement surface configured to engage edges of a second base block when the second face of the connector block is attached to the second base block; and a finish block for co-operation with the base block, comprising:

a base plate of the finish block that is generally flat and generally parallelogram shape having a first and second face on opposite sides of the base plate of the finish block;

wherein the first face of the base plate of the finish block has at least four generally cylindrical projections extending normally outward from the first face of the base plate of the finish block and arranged in two rows of opposed projections to define a square and a first engagement surface configured to engage the edges of the base block when the first face of the finish block is attached to the base block; and the second face of the base plate of the finish block is generally flat and smooth;

wherein the connector block connects the base block to a second base block by attaching the first face of the base plate of the connector block to one of the six female faces of the base block and attaching the second face of the base plate of the connector block to one of the six female faces of the second base block; and the finish block connects to the base block by attaching the first face of the base plate of the finish block to one of the six female faces of the base block; wherein a thickness of the base plate of the connector block from the first engagement surface of the connector block to the second engagement surface of the connector block is generally twice a thickness of the finish block from the first engagement surface of the finish block to the second face of the base plate of the finish block.

2. The building block system of claim 1, wherein the edges of the integral skeleton block form of the base block comprise edge angles that are positioned so an outside point of each edge angle is pointing towards an inside of the base block.

3. The building block system of claim 1, wherein the connector block has a hole in the base plate of the connector block that is generally located in the center of the square made by the rows of opposed projections.

4. The building block system of claim 1, wherein the base plate of the connector block comprises double beveled edges.

5. The building block system of claim 1, wherein the base plate of the finish block comprises beveled edges.

* * * * *